US007784985B2

(12) United States Patent
Meyrenaud

(10) Patent No.: US 7,784,985 B2
(45) Date of Patent: Aug. 31, 2010

(54) DUAL FUNCTION HEADLAMP FOR A MOTOR VEHICLE

(75) Inventor: Jean-Luc Meyrenaud, Livry Gargan (FR)

(73) Assignee: Valeo Vision, Bobigny (FR)

( * ) Notice: Subject to any disclaimer, the term of this patent is extended or adjusted under 35 U.S.C. 154(b) by 65 days.

(21) Appl. No.: 11/972,818

(22) Filed: Jan. 11, 2008

(65) Prior Publication Data

US 2008/0170407 A1 Jul. 17, 2008

(30) Foreign Application Priority Data

Jan. 12, 2007 (FR) ..... 07 00254

(51) Int. Cl.
*F21V 11/00* (2006.01)

(52) U.S. Cl. ..... 362/539; 362/538; 362/512; 362/516; 362/517; 362/518

(58) Field of Classification Search ..... 362/512, 362/514–518, 539, 277, 281–284, 513, 519, 362/307, 308, 310, 296.05–296.09
See application file for complete search history.

(56) References Cited

U.S. PATENT DOCUMENTS 6,059,436 A * 5/2000 Hashigaya ..... 362/544
6,467,940 B2 * 10/2002 Eschler et al. ..... 362/510
6,543,910 B2 4/2003 Taniuchi et al.
6,607,295 B2 * 8/2003 Hayakawa ..... 362/517
6,857,768 B2 * 2/2005 Watanabe et al. ..... 362/512
6,953,272 B2 * 10/2005 Hayakawa et al. ..... 362/517
2002/0089853 A1 * 7/2002 Taniuchi et al. ..... 362/297
2003/0086277 A1 5/2003 Hayakawa et al.
2004/0213012 A1 * 10/2004 Fukawa et al. ..... 362/539
2006/0203503 A1 9/2006 Casenave
2007/0064438 A1 3/2007 Ishida

FOREIGN PATENT DOCUMENTS

DE 10101258 7/2001
EP 1219887 A2 7/2002
EP 1260758 11/2002
EP 1701087 A2 9/2006

* cited by examiner

*Primary Examiner*—Jong-Suk (James) Lee
*Assistant Examiner*—Robert J. May
(74) *Attorney, Agent, or Firm*—Jacox, Meckstroth & Jenkins

(57) ABSTRACT

A dual function headlamp for motor vehicle fulfilling a first function as a beam with cut-off, in particular a dipped beam, and a second function as a second-type beam, in particular a full beam, comprising: an elliptical reflector with an interior focal point and an focal point on an optical axis; a light source placed in the vicinity of the interior focal point; an optics placed forward of the reflector and with a focal point merged with, or next to, the exterior focal point of the reflector; and a retractable shade that can occupy an active position for the beam with cut-off and a withdrawn position for the second-type beam, the shade in active position presenting a cut-off edge situated in the vicinity of the focal point of the optics. The retractable shade presents a reflective surface which, in withdrawn position, is placed in the lower part of the reflector, is turned forward and contributes to the second-type beam.

17 Claims, 4 Drawing Sheets

DUAL FUNCTION HEADLAMP FOR A MOTOR VEHICLE

BACKGROUND OF THE INVENTION

1. Field of the Invention

The invention relates to a dual function headlamp for a motor vehicle carrying out a first function being a beam with cut-off and a second function as a second-type beam, in particular a full beam.

2. Description of the Related Art

The headlamps concerned by the invention are of the type that comprises:

- an elliptical reflector with an interior focal point and an exterior focal point on an optical axis,
- a light source placed in the vicinity of the interior focal point,
- an optics placed in front of the reflector and with a focal point merged with, or next to, the exterior focal point of the reflector,
- and a retractable shade able to occupy an active position for the cut-off beam, and a withdrawn position for the second-type beam, the shade in active position presenting a cut-off edge in the vicinity of the focal point of the optics.

SUMMARY OF THE INVENTION

The purpose of the invention is, mainly, to provide a dual function headlamp, in particular dipped/full beam which, with a halogen-type light source, gives suitable brightness and luminous flux and in particular for the full beam. It is also desirable that the dual function module stand out, through its principle and its style, from current modules while retaining a retaining a relatively simple design.

According to the invention, the shade of the headlamp of the type defined above shade presents a reflective surface which, in withdrawn position, is placed in the lower part of the reflector, is turned forwards and contributes to the second-type beam. Preferentially, the shade is made up of a part of complex surface of a parabolic type.

By preference, the headlamp comprises in its lower part at least one fixed complex surface which only operates when the shade is in withdrawn position, to contribute to the second-type beam according to beams which pass through the optics placed in front of the reflector.

The headlamp has the advantage of at least one complex surface in its upper part arranged to reflect the beams above the lens contour and contribute to both the beam with cut-off and the second-type beam.

The shade can be retracted by rotation around a transverse horizontal axis, orthogonal to the optical axis.

The optics of the headlamp may be formed by a convergent lens. The lens may be mounted in a frame with radially projecting tabs allowing fixing on a housing while leaving a space free for the passage of light beams between the contour of the lens and the contour of the housing. The lens may be limited by two vertical rectilinear sides.

The shade control has the advantage of being operated by a step-by-step motor. The step-by-step motor control may have a so-called "motorway" function whereby the cut-off line of the dipped beam is raised by a few tenths of a degree, in particular between two and six tenths of a degree, in comparison with an ordinary dipped beam.

The headlamp may include a parking light set in the lower part in the free space between the contour of the lens and the contour of the housing.

In a manufacturing variation, the headlamp shade may be positioned according to at least one intermediate position between the active position and the withdrawn position, which makes it possible to generate a beam with a higher cut-off of the beam cut-off that the beam cut-off generated when the shade is in the active position. By preference, the movement of the shade from one position to another is achieved via a step-by-step motor.

These and other objects and advantages of the invention will be apparent from the following description, the accompanying drawings and the appended claims.

BRIEF DESCRIPTION OF THE DRAWINGS

The invention consists, apart from the arrangements set out above, in a certain number of other arrangements which will be more explicitly discussed below in reference to an example described in reference to the attached drawings, but which is in no way limitative. In these drawings.

DESCRIPTION OF THE PREFERRED EMBODIMENTS

Figure 1:
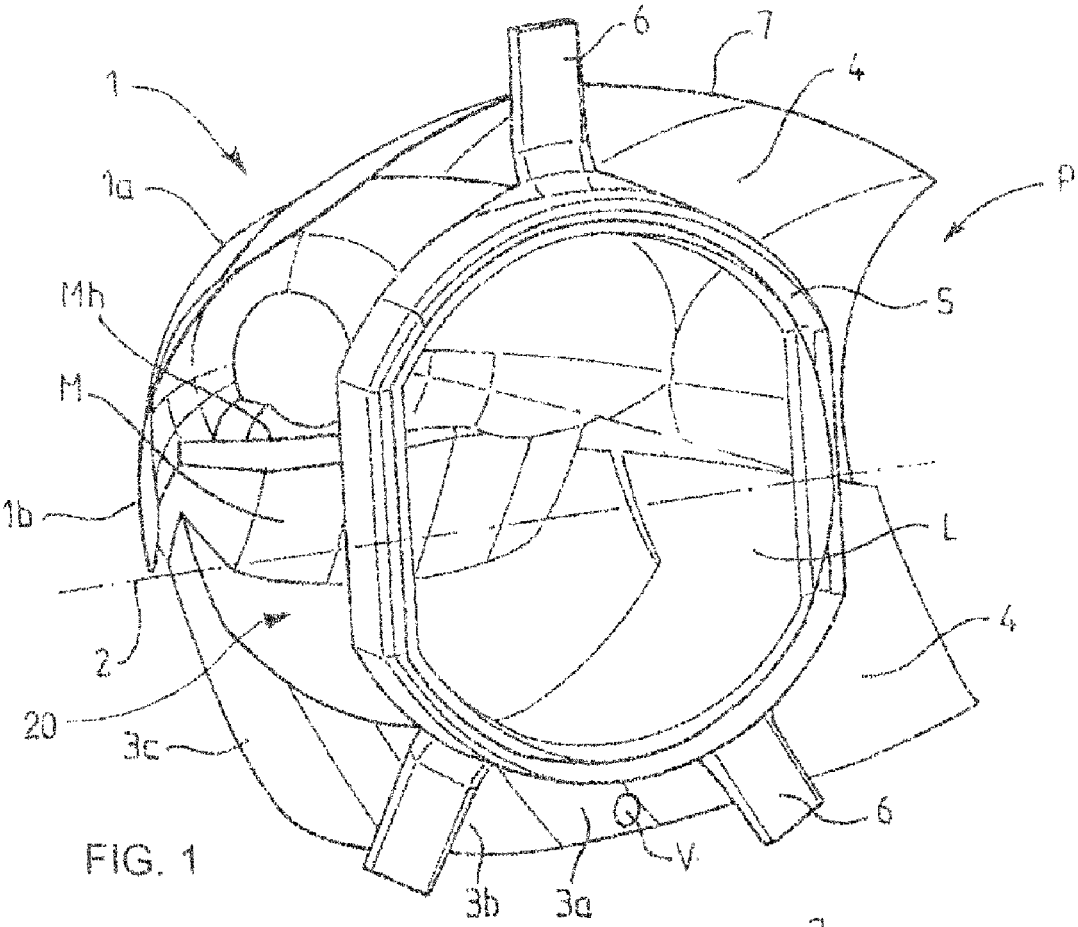
FIG. 1 is a schematic side perspective view of a headlamp as per the invention in dipped configuration, with the shade in active position.
Figure 2:
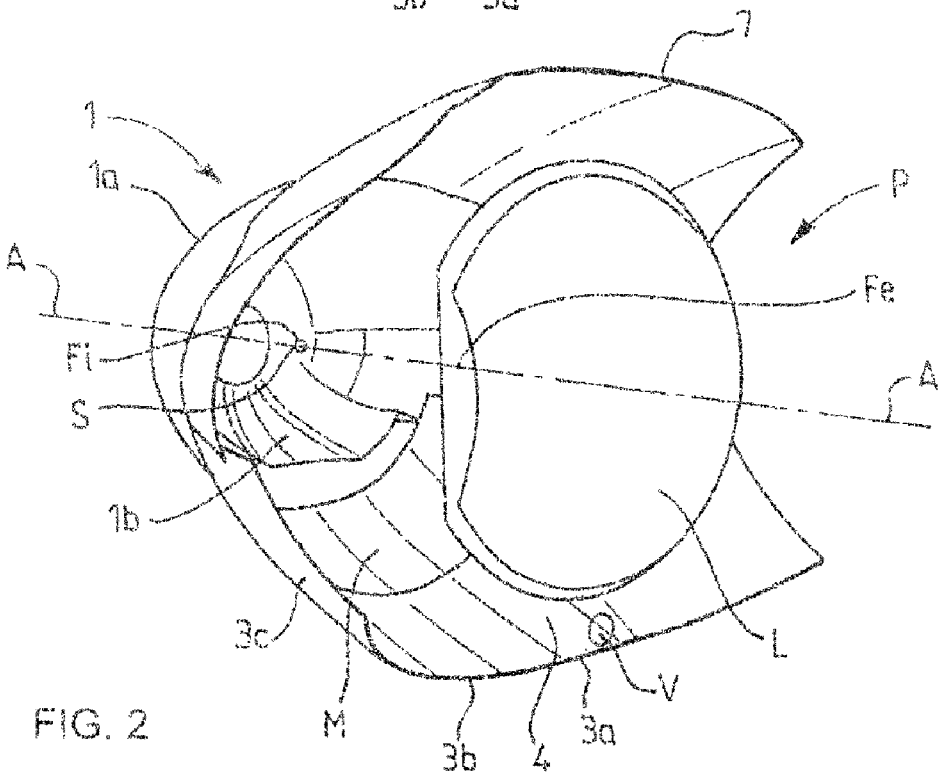
FIG. 2 is a schematic front perspective view of a headlamp as per the invention in full beam configuration, with the shade in withdrawn position.

Looking at FIGS. 1 and 2 in the drawings, one can see a motor vehicle headlamp P, designed to have a dual function, one being a beam with cut-off, i.e. a dipped beam, the other function being a second-type beam, i.e. a full beam.

Headlamp P comprises an ellipsoidal reflector 1, or more precisely one formed by a continuous or discontinuous series of surfaces of which each of the vertical generating lines, is close to an ellipse, and named for simplicity in the description and the claims an "elliptical reflector". When headlamp P is installed in the vehicle, the optical axis A-A of the reflector is approximately horizontal, parallel to the longitudinal direction of the vehicle. Elliptical reflector 1 comprises main part 1*a* above the horizontal plane passing via the optical axis A-A and lower part 1*b* below the horizontal plane which extends not so far forward as main part 1*a*. The terms "forward' and "backward" are to be taken following the direction of propagation of light rays which are reflected forwards.

Elliptical reflector 1 has an interior focal point Fi and an exterior focal point Fe on the optical axis A-A. A light source S, represented schematically by a point, is placed at the interior focal point Fi, or in its vicinity. Light source S may be a xenon lamp. An optics, formed by a convergent lens L, is set forward of elliptical reflector 1. The focal point of lens L is merged with, or next to, the exterior Fe focal point of elliptical reflector 1.

Figure 3:
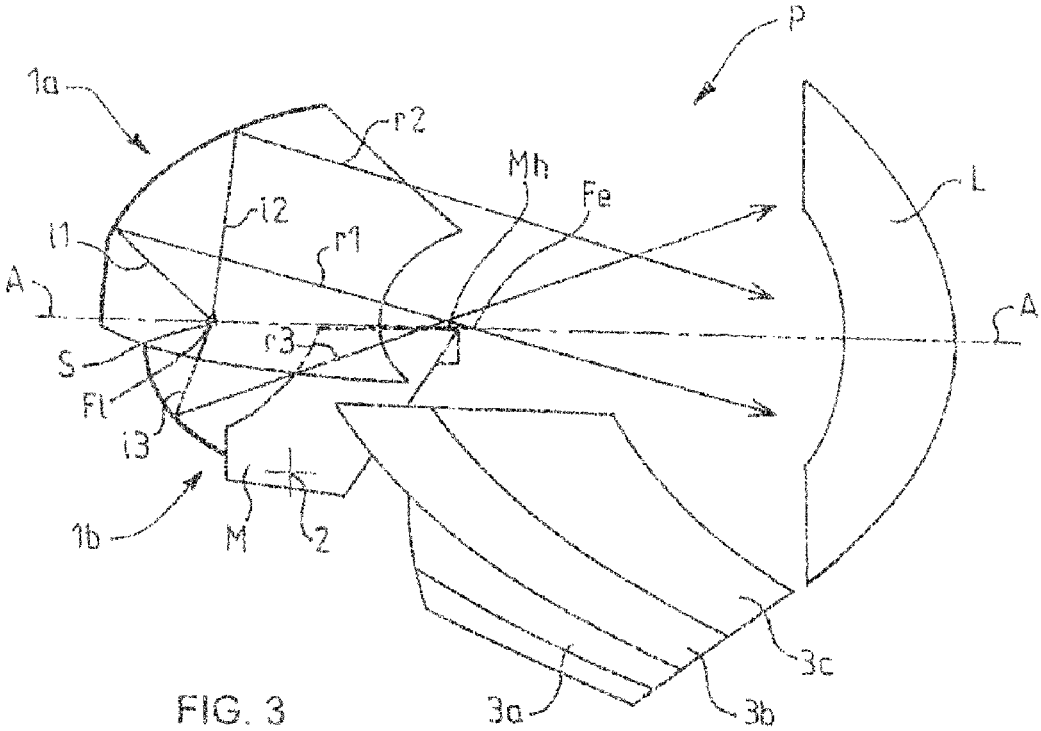
FIG. 3 is a schematic vertical section passing via the optical axis of the headlamp with the shade in active position, for a dipped beam.
Figure 4:
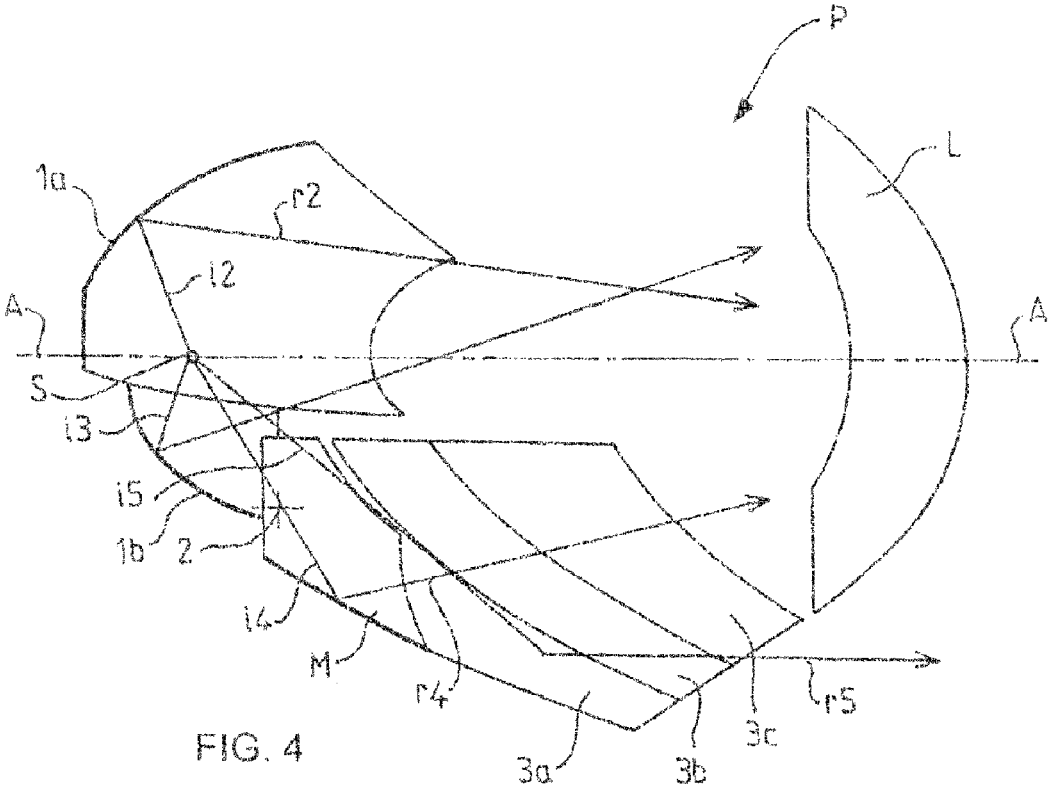
FIG. 4 is a vertical section similar to FIG. 3 of the headlamp with the shade in withdrawn position for a full beam.

A retractable shade M occupies an active position, illustrated in FIGS. 1 and 3, for a dipped beam with cut-off, or a withdrawn position, illustrated in FIGS. 2 and 4, for a full beam.

Shade M is rotation-mounted around a transverse axis 2 (FIG. 3), orthogonal to optical axis A-A, situated lower than this optical axis, and forward of focal point Fi. When shade M is in active position, its upper edge Mh is situated in the vicinity of the focal point of lens L and of the exterior focal point Fe, and forms the edge of the beam cut-off, the general orientation of which is approximately orthogonal to the optical axis A-A, in a horizontal plane.

In the invention, the retractable shade is formed by a part of complex surface of parabolic, reflective, type, which, in withdrawn position (FIGS. 2 and 4) is positioned in the lower part of elliptical reflector 1.

The expression "complex surface" or "parabolic-type complex surface" used in the description and the claims refers to a reflective surface generally made up of a number of facets whose are generating lines, in particular vertical lines, approaching parabolas. When the parabolic-type complex surface occupies the position in which it contributes to the beam, particularly when shade M is in the withdrawn position, the focal points of each facet are near to, or merged with, the lower focal point Fi of elliptical reflector 1.

The headlamp also has, in the lower part, at least one and preferably a number of complex reflective surfaces 3*a*, 3*b*, 3*c*, fixed in relation to elliptical reflector 1, which are used when shade M is in the withdrawn position (FIG. 4) to contribute to the full beam. Complex reflective surfaces 3*a*, 3*b*, 3*c* have their focal point situated in the vicinity of focal point Fi or merged with this focal point.

Rays such as r5 (FIG. 4) reflected by complex reflective surfaces 3*a*, 3*b*, 3*c*, parallel to optical axis A-A, pass below or to the sides of lens L in an annular space 4 which surrounds the lens between the contour of the lens and a housing (not shown) holding the headlamp. Lens L is held by frame 5 (FIG. 1) which as three radially projecting tabs 6 to fit it on the housing while leaving annular space 4 free.

The reflective array formed by elliptical reflector 1, and complex reflective surfaces 3*a*, 3*b*, 3*c*, has a notch, recess or cavity 20 in the lower part in which shade M is hidden in withdrawn position. The reflective surface of shade M is turned forwards, in this withdrawn position, to contribute to the full beam. The complex surface of shade M supplements that of complex reflective surfaces 3*a*, 3*b*, 3*c*.

Headlamp P may have, in the upper part, at least one complex reflective surface 7, as illustrated in FIG. 2, whose forward edge is at radial distance from the upper part of the lens. The focal point of complex reflective surface 7 is merged with, or next to, lower focal point Fi of elliptical reflector 1. Complex reflective surface 7 allows rays which contribute to the dipped and full beam to be reflected above lens L, whether shade M is in active or withdrawn position.

The front view of lens L shows a contour formed by an upper arc, a lower arc and, on each side, vertical rectilinear edges.

A parking light V may be installed above lens L, in the annular space 4, in an opening made in reflector 4.

Control of shade M has the advantage of being operated by a step-by-step motor (not shown) and enables a "motorway" function which raises the cut-off line of the dipped beam by a few tenths of a degree, particularly between two and six tenths of a degree, in comparison with the cut-off line of the ordinary dipped beam. This shift of the cut-off line is obtained by a set number of steps by the motor to lower the upper cut-off edge Mh, when shade M is in active position, which leads to a raising of the cut-off line of the beam.

Figure 5A:
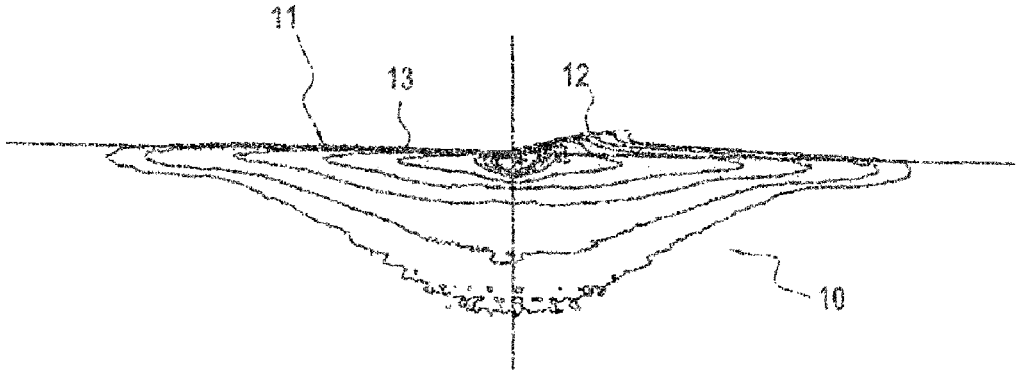
FIGS. 5A to 5E show the modulation of the headlamp beam as per an embodiment of this invention.
Figure 5B:
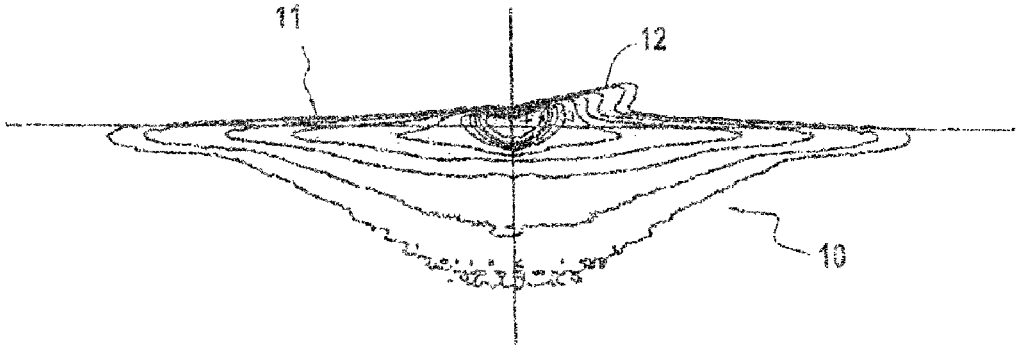
Figure 5C:
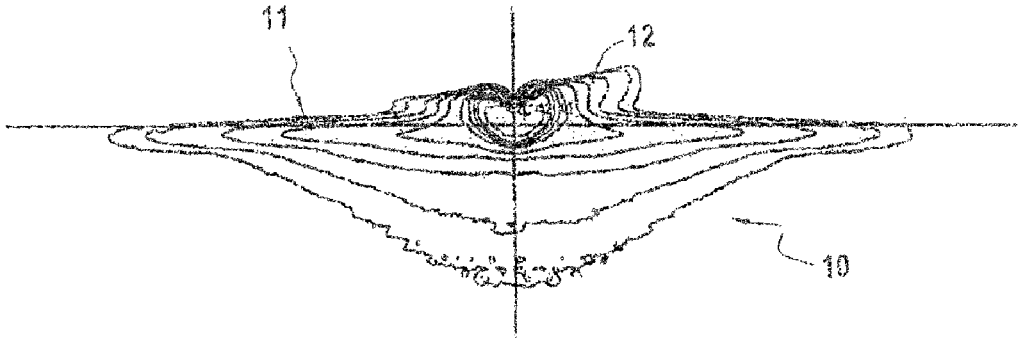
Figure 5D:
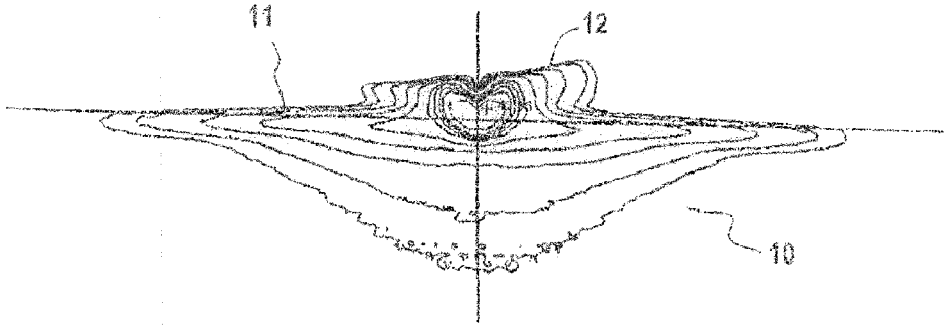
Figure 5E:
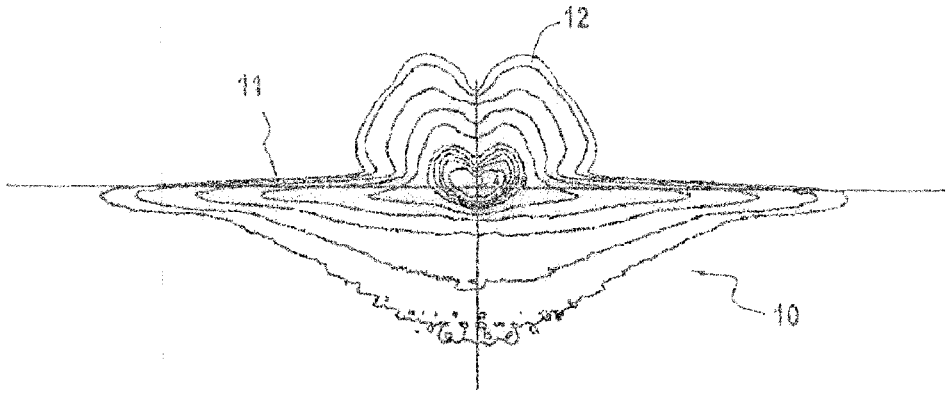

FIGS. 5A to 5E show the modulation of beam 10 of the headlamp via this invention obtained through an embodiment with step-by-step motor. FIG. 5A shows an ordinary dipped beam for driving on the right obtained when shade M is in active position. This ordinary dipped beam has a cut-off line 11, with an approximately horizontal portion 13, which avoids dazzling drivers crossing the path of or in front of a vehicle fitted with headlamps as per this invention, an oblique portion 12, enabling the right verge to be lit. FIG. 5E shows a full beam obtained when shade M is in withdrawn position. It should be noted that in an embodiment without step-by-step motor, with only two shade positions, the active and withdrawn positions, two forms of the dipped and full beams are obtained, as for example those shown in FIGS. 5A and 5E. In the embodiment with step-by-step motor, the shade will have one or more intermediate positions between the active position and the withdrawn position. By way of illustration, FIGS. 5B to 5D show the form of the beam obtained for three intermediate positions. Thus, in this example, shade M moves from the active position to a first intermediate position by an angle of 4 degrees, with the beam thus changing from a dipped-type beam (FIG. 5A) to a "motorway"-type beam with cut-off (FIG. 5B) in which the cut-off line 11 has been raised, not only with reference to the oblique portion 12, but also to the approximately horizontal cut-off portion situated to the left of this oblique portion 12. It is also possible to position shade M by having it move 8 degrees from its active position, to turn beam 10 into a form such as is shown in FIG. 5C, which is also a "motorway"-type beam but whose cut-off line 11 is higher than in FIG. 5B. To raise cut-off line 11 further, shade M can be brought to a third intermediate position, in which the shade moves 10 degrees from its active position; this gives the beams shown in FIG. 5D. Of course, the change in the beam can also be achieved by going from the withdrawn position towards the active position, choosing one of the positions for shade M so as to obtain the right beam. The number of intermediate positions may vary according to the embodiment. Also, the angle of variation between the active position and an intermediate position is give by way of example. Likewise, examples show cut-offs for driving on the right, but the embodiment is transposable for driving on the left. For driving on the left, the cut-offs shown will be inverted in relation to those for driving on the right so as to achieve symmetry along the vertical axis shown in FIGS. 5A to 5E.

The amplitude of rotation of shade M between the active position for dipped beam and the full beam position may be of the order of 80°.

Operation of the headlamp is as follows.

The first function, dipped beam, is obtained with shade M in active position shown in FIG. 1 or 3, source S being turned on. A ray i1 (FIG. 3) from source S that falls on the upper part of elliptical reflector 1 is reflected along a ray r1 passing through exterior focal point Fe, or the vicinity of this focal point. Ray r1 travels downwards and after having traversed lens L, exits parallel to optical axis A-A or with a downward inclination.

A ray i2 from the source that falls on the upper part of elliptical reflector 1 is reflected downwards as r2. Exiting lens L this ray will remain inclined downwards.

A ray i3 from source S and directed downwards is reflected, by the lower part 1*b* of the elliptical reflector, in a ray r3 directed upwards, which just brushes upper edge Mh of the shade. This ray r3, after having traversed lens L, exits parallel to optical axis A-A if it passes through the focal point of the lens, or refracted in a downward direction if this ray r3 cuts optical axis A-A behind the focal point of the lens.

The rays reflected by the lower part 1*b* of the reflector, and which would cut optical axis A-A in front of the focal point of the lens, are intercepted by shade M so that they cannot create parasitic rays exiting lens L in an upward direction and which would pass above the cut-off line required for the beam.

The second full beam function is obtained by ordering shade M to be lowered forwards, with a rotation of around 80° around transverse axis 2. Shade M once lowered sits in a notch in the lower part of the elliptical reflector 1 and the complex reflective surfaces 3*a*, 3*b*, 3*c*.

The concave reflective surface of shade M supplements the complex reflective surfaces 3*a*, 3*b*, 3*c* of headlamp P.

Ray i2, i3 are reflected by the main part 1 a and lower part 1*b* along rays r2, r3 which pass through lens L.

A ray such as i4 directed downwards falls on the concave reflective surface of shade M and is reflected along a ray r4 which also passes through the lens.

A ray such as i5 from the source falls on one of the complex reflective surfaces 3*a*, 3*b*, 3*c* and is reflected along a ray r5 which is approximately parallel to optical axis A-A and passes below lens L without being refracted.

The luminous flux obtained in full beam position is increased in comparison with that obtained with a simple elliptical reflector with a retractable shade.

When light source S is a halogen lamp, the invention produces a bi-halogen module with a good full beam flux and which, through its principle and its style, stands out from current modules. The headlamp as per the invention provides, for the full beam, an increase in flux of almost 25% in comparison with a standard bi-halogen.

The positioning of the moveable mirrorformed by shade M has little detrimental effect as its most important function is to recover flux for the full beam, mainly to give more convenience than traditional bi-halogen modules.

A headlamp as per the invention has great flexibility to distribute the luminous flux of the full beam according to the definition if the complex surfaces, while in a traditional module, by shifting the shade, hidden light is freed which is added to that of the dipped beam.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A dual function headlamp for a motor vehicle fulfilling a first function as a beam with cut-off, in particular a dipped beam, and a second function as a second type beam, in particular a full beam, comprising:

an elliptical reflector with an interior focal point and an exterior focal point on an optical axis and a recess or cavity located in the lower part thereof;

a light source placed in the vicinity of said interior focal point;

an optics placed in front of said elliptical reflector and having a focal point merged with, or next to, said exterior focal point of said elliptical reflector; and a retractable shade which occupies an active position for said beam with cut-off, and a withdrawn position for said second-type beam, said retractable shade in active position presenting a cut-off edge situated in the vicinity of said focal point of said optics;

wherein said retractable shade comprises an integral reflective surface that supplements the reflective surface of the reflector when the shade is turned forward in a withdrawn position and hidden within the recess or cavity of the lower part of said elliptical reflector, wherein the reflective surface of the shade reflects light toward said optical axis to contribute to said second-type beam.

2. The dual function headlamp as in claim 1, wherein said retractable shade is made up of a part of a complex surface of a parabolic type.

3. The dual function headlamp as in claim 1, wherein said dual function headlamp includes in a lower part thereof at least one fixed complex surface which is only used when said retractable shade is in withdrawn position, to contribute to said second-type beam via the rays which pass through said optics.

4. The dual function headlamp as in claim 1, wherein said dual function headlamp includes in its upper part at least one complex surface arranged to reflect the rays above a contour of said optics and contribute both to said beam with cut-off and to said second-type beam.

5. The dual function headlamp as in claim 1, wherein said retractable shade is retracted by rotation around a transversal horizontal axis, orthogonal to the optical axis.

6. The dual function headlamp as in claim 1, wherein said optics of said dual function headlamp is formed by a convergent lens.

7. The dual function headlamp as in claim 6, wherein said convergent lens is mounted in a frame with radially projecting tabs allowing fixation on a housing while leaving a free space for light rays to pass between said convergent lens and a contour of said housing.

8. The dual function headlamp as in claim 7, which includes a parking light installed in the lower part in said free space between a contour of said convergent lens and a contour of said housing.

9. The dual function headlamp as in claim 6, wherein said convergent lens is limited by two vertical rectilinear sides.

10. The dual function headlamp as in claim 1, wherein said retractable shade is controlled by a step-by-step motor.

11. The dual function headlamp as in claim 10, wherein the control of said step-by-step motor has a "motorway" function allowing the cut-off line of said dipped beam to be raised by a few tenths of a degree, in particular between two and six tenths of a degree, in comparison with an ordinary dipped beam.

12. The dual function headlamp as in claim 1, wherein said retractable shade may be positioned in at least one intermediate position situated between said active position and said withdrawn position, allowing a beam to be generated with a higher cut-off than the beam cut-off generated when said retractable shade is in said active position.

13. An elliptical reflector having an interior and exterior focal point along an optical axis thereof, for use with a light source positioned in the vicinity of the interior focal point and optics placed in front of said elliptical reflector, said elliptical reflector comprising:

an elliptical reflector body having a recess or cavity located in a lower part thereof;

the optics having a focal point coinciding with the exterior focal point of the elliptical reflector;

a retractable shade comprising an active position for a beam with cut-off and a withdrawn position for a second-type beam, said retractable shade, when in an active position, presenting a cut-off edge situated in the vicinity of said focal point of said optics;

wherein said retractable shade comprises an integral reflective surface which supplements the reflective surface of the elliptical reflector when the retractable shade is hidden within the recess or cavity of the lower part of said elliptical reflector to reflect light toward said optical axis providing said second-type beam.

14. The elliptical reflector as in claim 13, wherein said retractable shade is made up of a part of complex surface of a parabolic type.

15. The elliptical reflector as in claim 13, wherein said elliptical reflector includes in its lower part at least one fixed complex surface which is only used when said retractable shade is in withdrawn position, to contribute to said second-type beam via the rays which pass through said optics.

16. The elliptical reflector as in claim 13, wherein said elliptical reflector includes in its upper part at least one complex surface arranged to reflect the rays above a contour of said optics and contribute both to said beam with cut-off and to said second-type beam.

17. The elliptical reflector as in claim 13, wherein said retractable shade is retracted by rotation around a transversal horizontal axis, orthogonal to optical axis.

* * * * *